US006685609B2

(12) United States Patent
Carder

(10) Patent No.: US 6,685,609 B2
(45) Date of Patent: Feb. 3, 2004

(54) CARPET SEAMING POOL

(76) Inventor: Timothy Carder, 310 Cromwell Dr., Rochester, NY (US) 14610

( * ) Notice: Subject to any disclaimer, the term of this patent is extended or adjusted under 35 U.S.C. 154(b) by 63 days.

(21) Appl. No.: 10/050,073

(22) Filed: Jan. 18, 2002

(65) Prior Publication Data

US 2003/0139269 A1 Jul. 24, 2003

(51) Int. Cl.[7] ..... B25F 5/02

(52) U.S. Cl. ..... 492/13; 492/19; 492/35; 492/43; 492/44

(58) Field of Search ..... 492/13, 14, 16, 492/17, 19, 30, 35, 36, 43, 44; 29/270, 278, 238; 15/230.11; 294/8.6; 7/103; 156/579, 304.7, 71; 52/746.1; 428/34.1

(56) References Cited

U.S. PATENT DOCUMENTS 2,805,439 A * 9/1957 Parker ..... 15/230.11
D197,811 S * 3/1964 Reiling ..... D54/13
3,157,135 A * 11/1964 Fetrow et al. ..... 492/14
3,332,670 A * 7/1967 Swartz ..... 416/67
3,617,082 A * 11/1971 Sparks ..... 294/8.6
3,673,621 A * 7/1972 Pecorella ..... 7/103
3,714,674 A * 2/1973 Simoncioni ..... 15/230.11
3,745,624 A * 7/1973 Newman ..... 492/19
3,970,396 A * 7/1976 Brady ..... 401/208
4,224,726 A * 9/1980 Walker ..... 492/13
4,257,140 A * 3/1981 Downing ..... 15/230.11
4,439,904 A * 4/1984 Hoopengardner et al. .. 156/579
4,617,083 A * 10/1986 Yrizarris ..... 156/545
4,838,986 A * 6/1989 Rhoades et al. ..... 156/574
4,949,604 A * 8/1990 Squires ..... 81/488
5,206,979 A * 5/1993 Campbell ..... 492/13
5,242,362 A * 9/1993 Talamantez ..... 492/13
5,393,289 A * 2/1995 Green ..... 492/13
5,471,703 A * 12/1995 Niven ..... 15/230.11
5,984,392 A * 11/1999 Iannacone, Jr. ..... 294/8.6
6,049,970 A * 4/2000 Reis et al. ..... 29/798
6,122,807 A * 9/2000 Beltramini ..... 26/28
6,238,740 B1 * 5/2001 Janssen ..... 427/260
6,302,178 B1 * 10/2001 Givens ..... 156/579
6,484,341 B2 * 11/2002 Hefti et al. ..... 7/111

* cited by examiner

*Primary Examiner*—Charles T. Jordan
*Assistant Examiner*—T. Nguyen
(74) *Attorney, Agent, or Firm*—Shlesinger, Fitzsimmons & Shlesinger

(57) ABSTRACT

One carpet seaming tool has an elongate, generally straight handle having on one end thereof a U-shaped bracket having spaced, parallel legs. Secured intermediate its ends in a pair of registering openings in the legs of the bracket is an elongate shaft having rotatably mounted coaxially thereon three rollers, one positioned between the two legs of the bracket and the other two positioned adjacent opposite ends of the bracket. Each roller is generally spirally shaped in configuration, having a spirally shaped outer circumferential surface disposed to have rolling engagement with the surfaces of two carpet sections that are being seamed together. In an alternative form, the handle is curved slightly intermediate its ends, and in addition to having the three spirally shaped rollers on the one end thereof, it has also mounted on its opposite end a U-shaped bracket with an elongate shaft secured intermediate its ends in registering openings in the legs of the bracket. Three cylindrically shaped rollers are rotatably mounted coaxially on the shaft, thereby providing smooth, circumferential outer surfaces disposed to have rolling engagement with the above-noted carpet sections when the tool is used during a seaming operation.

11 Claims, 2 Drawing Sheets

CARPET SEAMING POOL

BACKGROUND OF THE INVENTION

This invention relates to carpet seaming tools, and more particularly to an improved such tool which functions, during use, to draw together the edges of the carpets that are being seamed together. More particularly this invention relates to an improved such tool having mounted thereon for rotation coaxially about a common axis a plurality of aligned, spirally shaped rollers which are designed to be rolled on the edges of the carpets that are to be seamed together.

During the installation of carpeting, it is quite commonplace to secure together, in abutting relation with each other, the edges of two different carpets or carpet sections. Typically this involves arranging the two carpet sections or carpets so that the two edges in question are disposed in confronting, engaged relation with each other. In order to secure the two edges in abutting relation to each other the edges are temporarily separated in order to secure to the floor or surface upon which the carpets are seated, a strip of material which is aligned with the proposed location of the carpet seam, and the upper surface of which has thereon an adhesive coating. One manner of seaming the carpet edges together involves a system such as disclosed in U.S. Pat. No. 6,302,178, wherein an iron is initially employed to heat and melt the adhesive, after which the iron is removably mounted upon a heavy seam weight having a plane bottom surface which is advanced along the seam to secure the confronting edges of the carpet to the heated, adhesive material.

Instead of employing a plane, flat weight item to secure a carpet seam, U.S. Pat. No. 4,224,726 and No. Des. 241,704 disclose carpet seam rollers which are rolled along the abutting edges of two carpet sections in order to urge and secure the abutting carpet sections to the underlying adhesive. The rollers in the first of the above-noted patents comprise a plurality of discs rotatably mounted adjacent each other on a common shaft, and with each disc comprising a plurality of radially disposed, angularly spaced teeth, the tips of which are disposed to be placed in rolling engagement with the sections of the carpet that are to be adhered to the adhesive. The rollers in the seaming tool disclosed in the above-noted U.S. design patent also comprise a plurality of discs mounted to rotate coaxially on each of three different shafts, with each disc also comprising a plurality of radially disposed, angularly spaced teeth similar in configuration to the teeth referred to in the U.S. Pat. No. 4,224,726. While these prior art devices may be affective in forcing sections of carpet into engagement with the underlying adhesive strip, nevertheless each roller comprises a large plurality of teeth shaped projections which tend in part to force carpet sections into engagement with the underlying adhesive, but at the same time upon being rotated through the carpet knap, also tend to leave undesirable marks in the underlying carpet and therefore form undesirable disturbed portions of the carpet adjacent each side of the associated seam.

It is an object of this invention, therefore, to provide improved carpet seaming tools utilizing rollers which are easier to manufacture and more inexpensive than prior rollers of the type noted above, and which also eliminate or avoid the introduction of any undesirable distortion of the associated knap or surface of the carpet sections adjacent opposite sides of the associated seam.

A further object of this invention is to provide an improved carpet seaming tool having a plurality of similar, spirally shaped rollers mounted for rotation coaxially about a shaft mounted upon one end of a handle that is utilized for urging the rollers against adjacent portions of a carpet or carpet sections that are to be seamed together.

Still another object of this invention is to provide an improved carpet seaming tool of the type described wherein two sets of rollers are mounted on opposite ends of a handle for rotation about spaced, parallel axes, one set of rollers being of like, spiral configuration, and the other set being of like, cylindrical configuration.

Other objects of the invention will be apparent hereinafter from the specification and from the recital of the appended claims, particularly when read in conjunction with the accompanying drawings.

SUMMARY OF THE INVENTION

One tool includes a cylindrically shaped metal handle surrounded at one end by a plastic hand grip, and secured at its opposite end centrally to the outer surface of the central, planar section of a U-shaped bracket, with the axial centerline of the handle inclined transversely at an angle of about 45° to the center of the bracket. The bracket has two spaced, parallel legs which project from opposite ends of the center section at right angles to its inside surface, and which have therein a pair of registering openings. A shaft which is secured intermediate its ends in the registering openings on the bracket legs have rotatably mounted thereon three rollers one of which rotates on the shaft between the bracket legs, and the other two of which rotate on the shaft at opposite ends of the bracket. Each roller is spirally shaped intermediate its ends, and has formed thereon an outer, circumferential, spirally shaped surface which is disposed to roll on the surfaces of the two sections of the carpet that are being seamed together. In another embodiment the metal handle is curved intermediate its ends and has secured at the opposite end thereof another U-shaped bracket, which has secured intermediate its ends in registering openings in its two legs another shaft upon which are rotatably mounted three cylindrically shaped rollers, one of which rotates between the bracket legs and the other two of which rotate adjacent opposite ends of the bracket. When the tool is placed in use the cylindrically shaped rollers are disposed to have the smooth outer surfaces thereof in rolling engagement of the same carpet section engaged by the spirally shaped rollers carried on the opposite end of the handle.

THE DRAWINGS

DETAILED DESCRIPTION OF THE PREFERRED EMBODIMENTS

Figure 1:
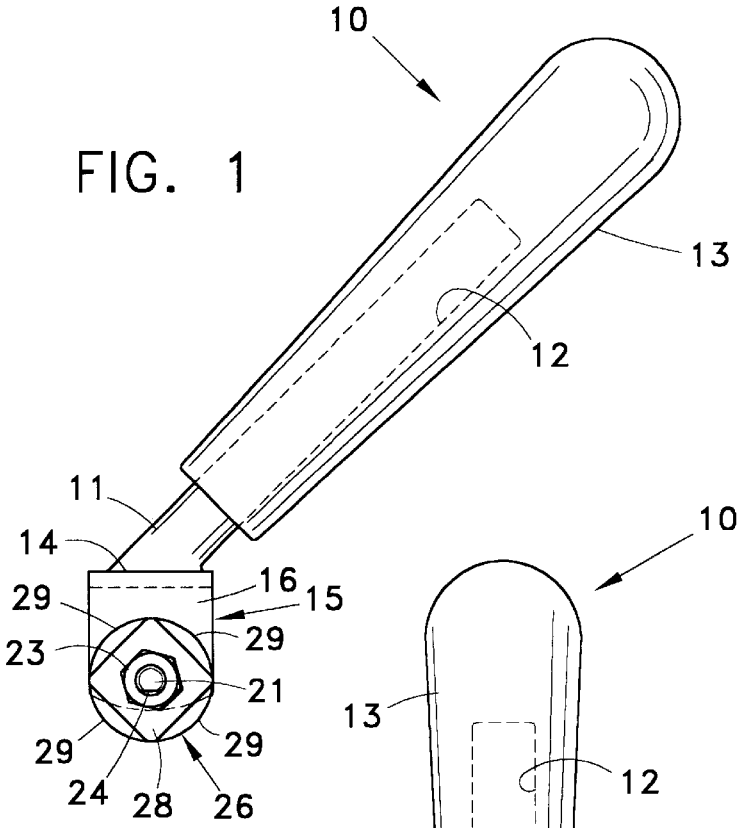
FIG. 1 is a side elevational view of a carpet seaming tool made according to one embodiment of this invention, as seen when looking at one end of a plurality of coaxially disposed rollers rotatably mounted on one end of a handle of the roller.
Figure 2:
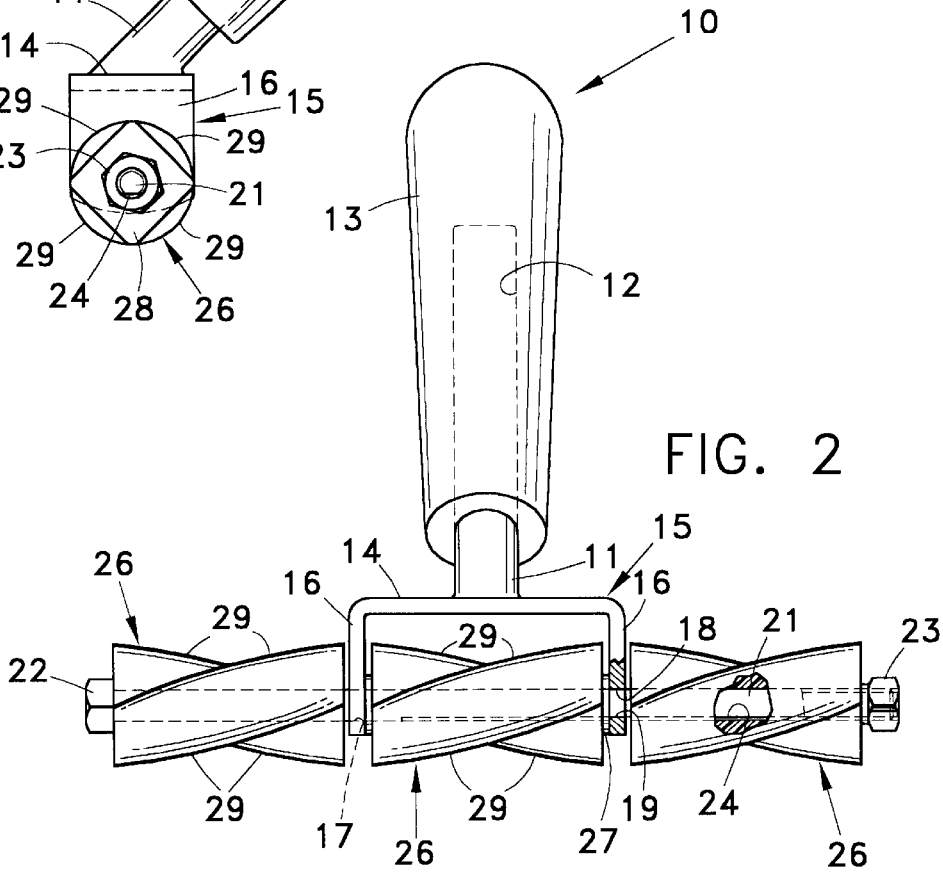
FIG. 2 is a front elevational view of this tool with portions broken away and shown in section.

Referring now to the drawings by numerals of reference, and first to the embodiment shown in FIGS. 1 and 2, 10 denotes generally a carpet seaming tool comprising a metal, cylindrically shaped shaft 11 which at one end thereof (the upper end in FIGS. 1 and 2) extends coaxially into, and is secured within, a circular blind bore 12 which extends coaxially into one end (the lower end in FIGS. 1 and 2) of an enlongate hand grip 13, which is circular in cross section. At its opposite end (the lower end in FIGS. 1 and 2), the shaft 11 extends out of the hand grip section 13 and is secured by welding, or the like, centrally to the plane outer surface of the central section 14 of a generally U-shaped metal bracket which is denoted generally in FIGS. 1 and 2 by the numeral 15. As shown in FIGS. 1 and 2 the shaft 11 is secured to bracket 15 in such a manner that its axial centerline extends transversely of, and is inclined at approximately 45° to the bracket center section 14. Integral with opposite ends of center section 14, and projecting therefrom equidistantly in the same direction and at right angles thereto, are two spaced, parallel bracket legs 16 which lie in planes equi-spaced from and parallel to the plane containing the axial centerline of shaft 11.

As shown in FIG. 2, the bracket leg 16 to the left of the hand grip 13 has therethrough adjacent its lower end a circular opening 17, which registers coaxially with a generally similar circular opening 18 formed on the bracket of leg 16 located to the right of the hand grip 13 in FIG. 2. Opening 18 is generally similar to opening 17 in the sense that the majority of opening 18 is defined by a peripheral surface which is disposed coaxially of a corresponding peripheral surface in the opening 17, but which at opposite ends thereof terminates in a flat, chordal surface 19 that is radially spaced from and extends transversely of a common axis of the openings 17 and 18. Removably mounted intermediate its ends in the registering openings 17 and 18 in the bracket legs 16 is an elongate roller mounting shaft 21 having fixed to one end thereof (the left end as shown in FIG. 2) a hexogonally shaped head 22, and having removably threaded onto the opposite end thereof a similarly shaped nut 23. For a substantial portion of its axial length at one end thereof (the left end thereof as shown in FIG. 2), the shaft 21 has a diameter only slightly less than the diameter of the circular opening 17 in the bracket leg 16 shown to the left in FIG. 2. For the remaining portion of its axial length the shaft 21 has machined or otherwise formed in its outer peripheral surface a chordal flat surface 24 which extends parallel to the axis of the shaft 21, and which seats against the corresponding chordal flat 19 in the opening 18 to prevent rotation of the shaft 21 relative to bracket 16, but at the same time permits axial movement of the shaft 21 relative to the bracket for the purpose of removably mounting the shaft in the bracket 16.

Mounted for rotation on shaft 21 coaxially thereof are three, similar, spirally shaped, axially bored rollers or wheels, each of which has a spirally shaped outer circumferential surface and is denoted generally by the numeral 26. As shown more clearly in FIG. 2, two of the wheels 26 are mounted to rotate on shaft 21 adjacent opposite ends thereof, in confronting relation to the outer surfaces of the bracket legs 16, while the third is mounted to rotate between the bracket legs 16 and a pair of conventional washers 27 that are rotatable on shaft 21 between the bracket legs 16 and opposite ends of the associated wheel 26. One of the two remaining wheels 26, the one shown on the left end of shaft 21 in FIG. 2, rotates between the head 22 of the shaft and one of the legs 16 of the bracket 15. At the opposite end of the shaft the remaining wheel 26 rotates between the other leg 16 of the bracket 15 and the nut 23. Notably also the last-mentioned wheel 26, as well as the wheel 26 between the bracket legs 16, have an inside diameter which permits them to rotate coaxially on shaft 21 without any interference with the chordal flat surface 24 that extends for a substantial portion of the axial length of shaft 21.

In practice the wheels 26 can be produced from a plastic, Acrylic product that is sold by General Electric Corporation as a "Spiral Rod". The rod has the configuration of an elongate rod which is rectangular in cross section, and which appears to have been twisted coaxially about its axial centerline. As a result, when the rod is cut on a plane extending transversely through and at right angles to the axis of the rod, the thus severed surface is rectangular in configuration as denoted by the numeral 28 in FIG. 1. Intermediate its ends, each wheel 26 therefore has formed on its outer surface four equi-angularly spaced and spirally shaped edges 29, which are disposed to have rolling engagement with the edges of the carpets or carpet sections that are to be seamed together.

For example, as will be apparent to one skilled in the art, when the tool 10 is placed in use, the operator, while gripping the handle 13, urges the center wheel (the wheel between the bracket legs 16) into engagement with the seam formed by the abutting edges of the carpets or carpet sections and then urges the tool under pressure longitudinally of the carpet seam. At such time the two outer wheels 26 likewise roll along portions of the carpet or carpet sections adjacent opposite sides of the seam, thereby urging the engaged sections of the carpet downwardly and slightly toward the seam. Moreover because of the curved edges 29 of the wheels 26 rolling across the carpet there is little or no distortion or undesirable marking of the underlying portions of the carpet during the seaming operation.

Figure 3:
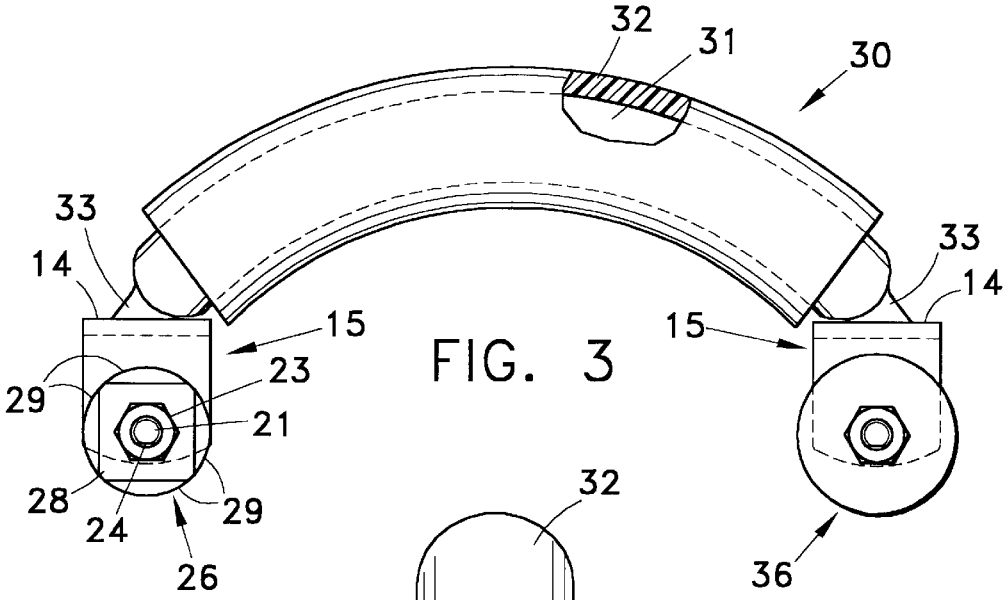
FIG. 3 is a side elevational view of a tool made according to another embodiment of this invention, the two sets of rollers carried at opposite ends of the handle in this embodiment being viewed from one end thereof.
Figure 4:
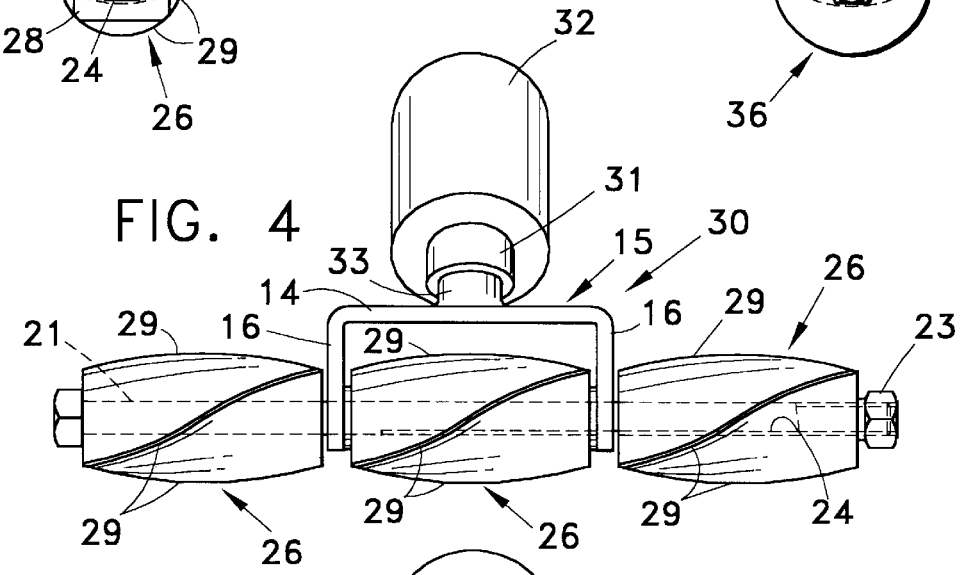
FIG. 4 is an end elevational view of this tool as seen when looking at the left end of the tool as shown in FIG. 3.
Figure 5:
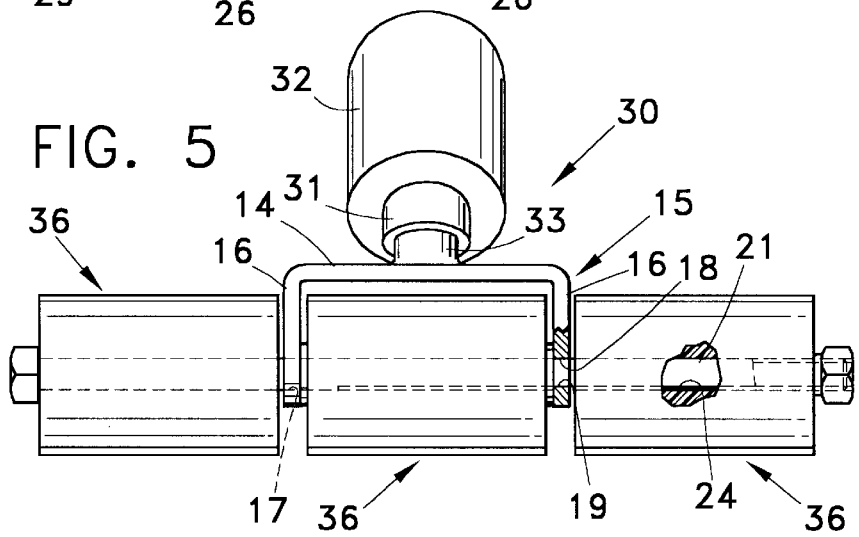
FIG. 5 is an end elevational view of this tool as seen when looking at the right end of the tool as shown in FIG. 3, and with portions of the tool broken away and shown in section.

Referring now to the embodiment illustrated in FIGS. 3 to 5, wherein like numerals are employed to denote elements similar to those employed in the first embodiment, 30 denotes generally a modified carpet seaming tool comprising a metal, cylindrically shaped shaft 31 which, unlike the straight shaft that was employed for a handle in the first embodiment, is curved into a slight accurate shaft intermediate its ends. The arcuately shaped shaft 31 is surrounded intermediate its ends by a resilient, rubber sleeve or hand grip 32. Shaft 31 projects slightly beyond opposite ends of the hand grip 32, and is secured at one end thereof by a weld 33, or the like, to the central section 14 of a metal, U-shaped bracket 15 of the type employed in the first embodiment. As shown in FIG. 4, bracket 14 has mounted thereon the same shaft 21 and associated wheels 26 as in the first embodiment.

On its opposite end shaft 31 is also connected by a weld 33, or the like, to the central section 14 of another generally U-shaped metal bracket of the type employed in the first embodiment, and which is denoted generally by the numeral 15. Also as in the first embodiment one leg 16 of the bracket 15 (left hand leg as shown in FIG. 5) has therethrough adjacent its lower end a conventional circular opening 17 which, as in the first embodiment, registers coaxially with an opening 18 in the other leg having in its periphery a chordal flat 19. Mounted intermediate its ends to extend coaxially through the opening 17 and 18 in the bracket legs 16 is an elongate shaft 21 similar to that employed in the first embodiment, and which therefore has formed thereon adjacent one end thereof (the right end as shown in FIG. 5) a corresponding flat 24 which engages the flat 19 in the opening 18 to prevent rotation of shaft 21 in the bracket 16.

However, in this embodiment, the shaft 21 has rotatably mounted thereon, instead of the spirally shaped wheels 26, three, like, axially bored, cylindrically shaped plastic rollers which are denoted generally by the numerals 36. The rollers 36 are made from a generally rigid plastic material and have smooth, circumferential outer surfaces which are disposed to engage carpeting during the use of the tool 30 as noted hereinafter.

In use, the modified tool 30 is manipulated to roll its wheels 26 into engagement with the portions of the carpet sections or carpets that are being seamed together, in a manner similar to that described in connection with the first embodiment. However during this operation the cylindrically shaped rollers 36 will also roll into contact with the same portions of the carpet or carpeting after those portions have been engaged by the spirally shaped rollers 26. The cylindrically shaped rollers 34 help to stabilize the carpet seaming operation of the spirally shaped wheels of rollers 26, and also tend to remove any disturbances which may have been created in the surface of the carpet during the passage thereover of the rollers or wheels 26.

In view of the foregoing, it is respectfully submitted that the tools disclosed herein considerably simplify the manufacture and operation of carpet seaming tools of the type described, and also minimize if not completely remove entirely all of the undesirable marks heretofore left by prior art of the type described. Even more importantly, by employing spirally shaped carpet seaming rolls or wheels of the type described herein, it has been found that the confronting sections of the carpets that are to be seamed together are likewise uniformly drawn toward one another upon being passed over by the spirally shaped wheels or rollers employed by the tools disclosed herein.

While the tools disclosed herein have been illustrated and described in connection with only certain embodiments thereof, it will be readily apparent to one skilled in the art that the tools are capable of still further modification, and that this application is intended to cover any such modifications as may fall within the scope of one skilled in the art or the appended claims.

What is claimed is:

1. A tool for use in seaming together the confronting edges of two adjacent sections of carpet, comprising an elongate handle having a longitudinal centerline, a shaft removably secured intermediate its ends to one end of said handle with the axis thereof extending normal to the centerline of said handle, a plurality of similar, axially spaced rollers mounted on said shaft for rotation coaxially thereabout, and said rollers having spirally shaped outer circumferential surfaces disposed to have rolling engagement with the carpet sections being seamed, each of said rollers in a plane extending therethrough and at right angles to the axis thereof is rectangular in cross section.

2. A tool as defined in claim 1, wherein one of said rollers registers centrally with said handle and is positioned between two others of said rollers.

3. A tool as defined in claim 1, wherein each of said rollers in a plane extending therethrough and at right angles to the axis thereof is rectangular in cross section.

4. A tool as defined in claim 1, including a second shaft removably secured intermediate its ends to the opposite end of said handle with the axis thereof extending normal to the centerline of said handle and parallel to the axis of the first-named shaft, and a plurality of similar, cylindrically shaped rollers rotatably mounted on said second shaft to have rolling engagement with carpet sections concurrently with said rollers on said first-named shaft.

5. A tool as defined in claim 4, wherein said handle is curved in the form of an arc intermediate said ends thereof.

6. A tool as defined in claim 1, including a rigid U-shaped bracket having a central section fixed at one side thereof to said one end of said handle, and having a pair of spaced, parallel legs integral with and projecting at right angles from the opposite side of said central section, and said first-named shaft being releasably secured intermediate its ends in registering openings in said bracket legs.

7. A tool as defined in claim 6, wherein the centerline of said handle is straight and extends transversely of and is inclined relative to said central section of said bracket.

8. A tool as defined in claim 6, including a second, rigid U-shaped bracket having a central section fixed at one side thereof to the opposite end of said handle, and having a pair of spaced, parallel legs integral with and projecting from the opposite side of the central section of said second bracket, a second shaft secured intermediate its ends in registering openings in said legs of said second bracket, and a plurality of similar, axially spaced, rollers mounted on said second shaft for rotation thereabout, and for rolling engagement with the carpet sections being seamed.

9. A tool as defined in claim 8, wherein each of said rollers on said second shaft is cylindrical in configuration, and said handle is curved in the form of an arc intermediate said ends thereof.

10. A tool as defined in claim 6, wherein one of said rollers on said first-named shaft is positioned to rotate between said bracket legs.

11. A tool as defined in claim 8, wherein one of said rollers on each of said shafts is positioned to rotate between the two legs of the respective bracket to which the associated shaft is releasably secured.

* * * * *